US006827337B2

(12) United States Patent
Terakado

(10) Patent No.: US 6,827,337 B2
(45) Date of Patent: Dec. 7, 2004

(54) ROTARY THROTTLE VALVE CARBURETOR

(75) Inventor: Hitoshi Terakado, Miyagi (JP)

(73) Assignee: Walbro Japan, Inc., Tokyo (JP)

( * ) Notice: Subject to any disclaimer, the term of this patent is extended or adjusted under 35 U.S.C. 154(b) by 641 days.

(21) Appl. No.: 09/817,531

(22) Filed: Mar. 26, 2001

(65) Prior Publication Data

US 2001/0029700 A1 Oct. 18, 2001

(30) Foreign Application Priority Data

Mar. 29, 2000 (JP) ..... 2000-091910

(51) Int. Cl.[7] ..... F02M 9/08
(52) U.S. Cl. ..... 261/44.3; 261/44.6; 261/44.8
(58) Field of Search ..... 261/44.2–44.8

(56) References Cited

U.S. PATENT DOCUMENTS

| | | | | | |
|---|---|---|---|---|---|
| 1,951,262 | A | * | 3/1934 | Townsley | 261/34.2 |
| 2,630,304 | A | * | 3/1953 | Rivoche | 261/44.8 |
| 3,333,832 | A | * | 8/1967 | O'Neill | 261/39.3 |
| 4,175,102 | A | * | 11/1979 | Greiner et al. | 261/50.2 |
| 4,237,079 | A | * | 12/1980 | Greiner et al. | 261/44.2 |
| 4,455,979 | A | * | 6/1984 | Brown | 123/406.69 |
| 4,481,153 | A | * | 11/1984 | Kobayashi et al. | 261/44.2 |
| 5,599,484 | A | | 2/1997 | Tobinai | 261/44.2 |
| 5,709,822 | A | | 1/1998 | Togashi | 261/44.2 |

FOREIGN PATENT DOCUMENTS

| | | | | |
|---|---|---|---|---|
| JP | 58-101253 | * | 6/1983 | 261/44.8 |
| JP | 1-142255 | * | 6/1989 | 261/44.8 |

* cited by examiner

*Primary Examiner*—Richard L. Chiesa
(74) *Attorney, Agent, or Firm*—Reising, Ethington, Barnes, Kisselle, P.C.

(57) ABSTRACT

A rotary throttle valve carburetor has a fuel-and-air mixing passage which extends through a carburetor body. A cylindrical throttle chamber extends down from a top surface of the body and communicates transversely with the fuel-and-air mixing passage. A rotary throttle seats rotatably and vertically or axially movable within the chamber and through the fuel-and-air mixing passage. The rotary throttle has a bore fully communicating and longitudinally aligned with the fuel-and-air mixing passage at wide-open throttle. The rotary throttle has a throttle shaft projecting upward through the top surface of the carburetor body and through a hole of a base portion of a plastic lid plate engaged between the top surface and a metallic bracket. An upward projecting annular shoulder of the lid plate is disposed concentrically to and spaced radially apart from the throttle shaft. A circular seal is disposed radially between the annular shoulder of the lid plate and the throttle shaft to prevent dirt from entering the valve chamber. A metallic cam follower engages the bracket and contacts a cam surface of a throttle lever engaged transversely to the upper end of the throttle shaft. The metallic cam follower or bracket is interconnected to the metallic carburetor body by a plurality of metallic spacers.

13 Claims, 3 Drawing Sheets

ROTARY THROTTLE VALVE CARBURETOR

FIELD OF THE INVENTION

This invention relates to a carburetor, and more particularly to a rotary throttle valve carburetor for a two-cycle engine.

BACKGROUND OF THE INVENTION

In a conventional rotary throttle valve carburetor a fuel-and-air mixing passage extends usually horizontally through a carburetor body providing a fuel-and-air mixture to the crankcase of a two-cycle engine. A throttle chamber communicates transversely through the fuel-and-air mixing passage and usually extends vertically through the carburetor body. A rotary throttle seats rotatably and vertically or axially movably within the chamber extending through the fuel-and-air mixing passage. The rotary throttle has a throttle bore which communicates adjustably with the fuel-and-air mixing passage. The rotary throttle extends upward from the carburetor body through a plastic lid plate engaged between the metallic carburetor body and a metallic bracket (retaining plate).

A throttle lever engaged to the upper end of the rotary throttle has a cam surface which slides over a cam follower of the bracket when the rotary throttle is rotated. During rotation, contact of the cam surface with the cam follower causes axial movement of the rotary throttle which in-effect adjusts the flow of fuel into the throttle bore. Because the bracket is supported by the plastic lid plate, age deformation of the plastic lid plate can alter the height or location of the cam follower, thereby changing the axial placement of the rotary throttle at a prescribed rotational location and altering the fuel flow.

To ensure dust and debris does not enter the throttle chamber between the throttle shaft and the plastic lid plate, a conventional rubber boot envelopes the protruding portion of the rotary throttle and throttle lever while securing about the carburetor body. The rubber boot, however, may harden with age and ultimately break off. At which point, dirt and dust can enter the throttle chamber making it difficult to rotate the rotary throttle and degrading consistent fuel flow by altering the vertical or axial placement or location of the rotary throttle within the throttle chamber.

The plastic lid plate is typical pressed against the top surface of the carburetor body via the bracket and a plurality of bolts thereby forming a seal. Should the plastic lid plate deform with age, the potential exists for dirt and dust to enter the throttle chamber between the deformed plastic lid plate and the metallic carburetor body. Even without deformation of the plastic lid plate, imperfections or scratches formed on the top or sealing surface of the carburetor body during casting or otherwise can create clearances in which dust can enter the throttle chamber.

SUMMARY OF THE INVENTION

A rotary throttle valve carburetor has a fuel-and-air mixing passage which extends through a carburetor body. A cylindrical throttle chamber extends down from a top surface of the body and communicates transversely with the fuel-and-air mixing passage. A rotary throttle seats rotatably and vertically or axially movable within the chamber and through the fuel-and-air mixing passage. The rotary throttle has a bore fully communicating and longitudinally aligned with the fuel-and-air mixing passage at wide-open throttle.

The rotary throttle has a throttle shaft projecting upward through the top surface of the carburetor body and through a hole of a base portion of a plastic lid plate engaged between the top surface and a metallic bracket. An upward projecting annular shoulder of the lid plate is disposed concentrically to and spaced radially apart from the throttle shaft. A circular seal is disposed radially between the annular shoulder of the lid plate and the throttle shaft to prevent dirt from entering the valve chamber. A metallic cam follower engages the bracket and contacts a cam surface of a throttle lever engaged transversely to the upper end of the throttle shaft. The metallic cam follower or bracket is interconnected to the metallic carburetor body by a plurality of metallic spacers.

Preferably, the circular seal has a reinforcement metallic sleeve engaged to the lid plate and a baked on resilient member engaging the throttle shaft. Preferably, any clearance between the base portion of the plastic lid plate and the top surface of the carburetor body is sealed by an O-ring which seats into a circular groove defined by the top surface. Preferably, the lid plate has a lower annular shoulder which extends downward from the base portion and is press fit with a cylindrical wall of the carburetor body which extends downward from the top surface to a recessed annular shelf disposed concentrically about the throttle shaft. Preferably, the cam follower is a rotating pin projecting from a cylinder engaged to the bracket.

Objects, features, and advantages of this invention include a throttle chamber well sealed from the intrusion of dust and dirt, a reliable and friction free cam follower, and consistent fuel delivery and engine operation with age or throughout its in service useful life.

By the provision of a line contact between the cam follower and the cam surface, the surface pressure is decreased to stabilize the operating load and enhance the abrasion resistance.

The bracket is diecast to thereby enhance the strength, prevent deformation when dropped, enhance processing accuracy, and provide a partial stopper as an additional function.

There is no increase in operating load and damage of the surface due to the hardening of the resilient seal member, intrusion of dust is prevented by the resilient seal member and stability of operation of the throttle lever and flow rate of fuel are obtained without being adversely affected by the vertical movement and rotation of the rotary throttle.

A plurality of positioning bosses provided on the carburetor body eliminate deviation of the plastic lid plate and enhance assembly of the carburetor.

A clearance between the carburetor body and the plastic lid plate is sealed by an O-ring to thereby prevent intrusion of dust into the valve chamber due to the deformation of the seal surface, scratches, oil wrinkles or the like.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENT

Figure 1:
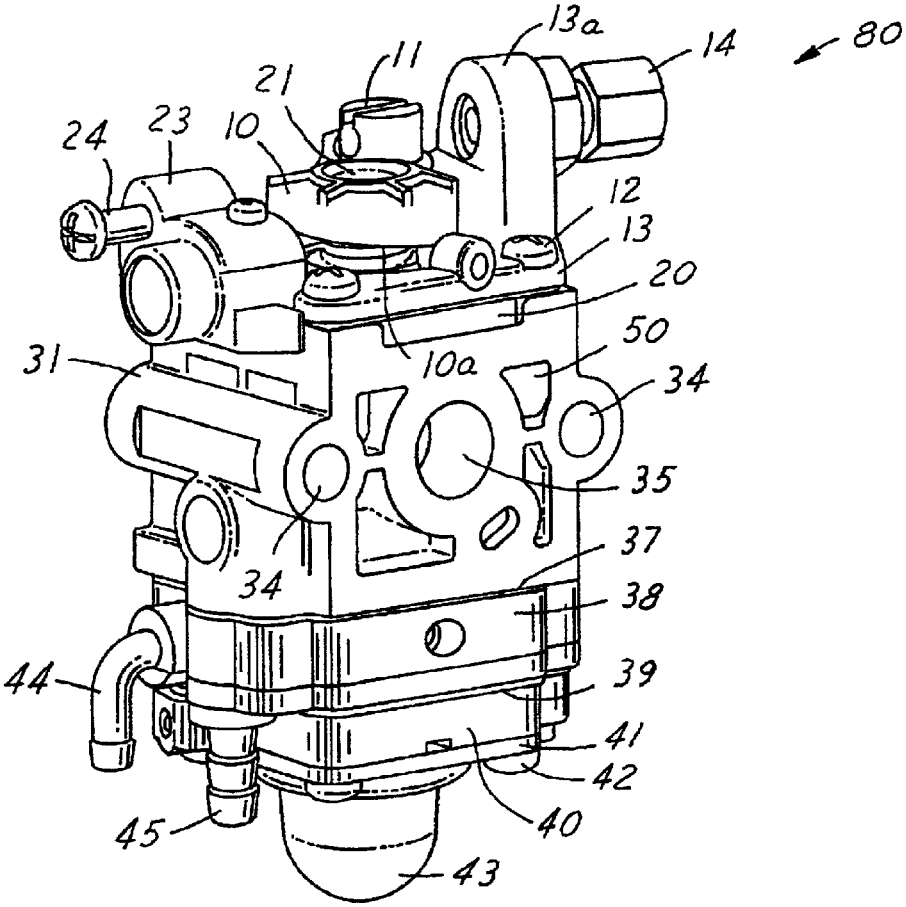
FIG. 1 is a perspective view of a rotary throttle valve carburetor according to the present invention.
Figure 2:
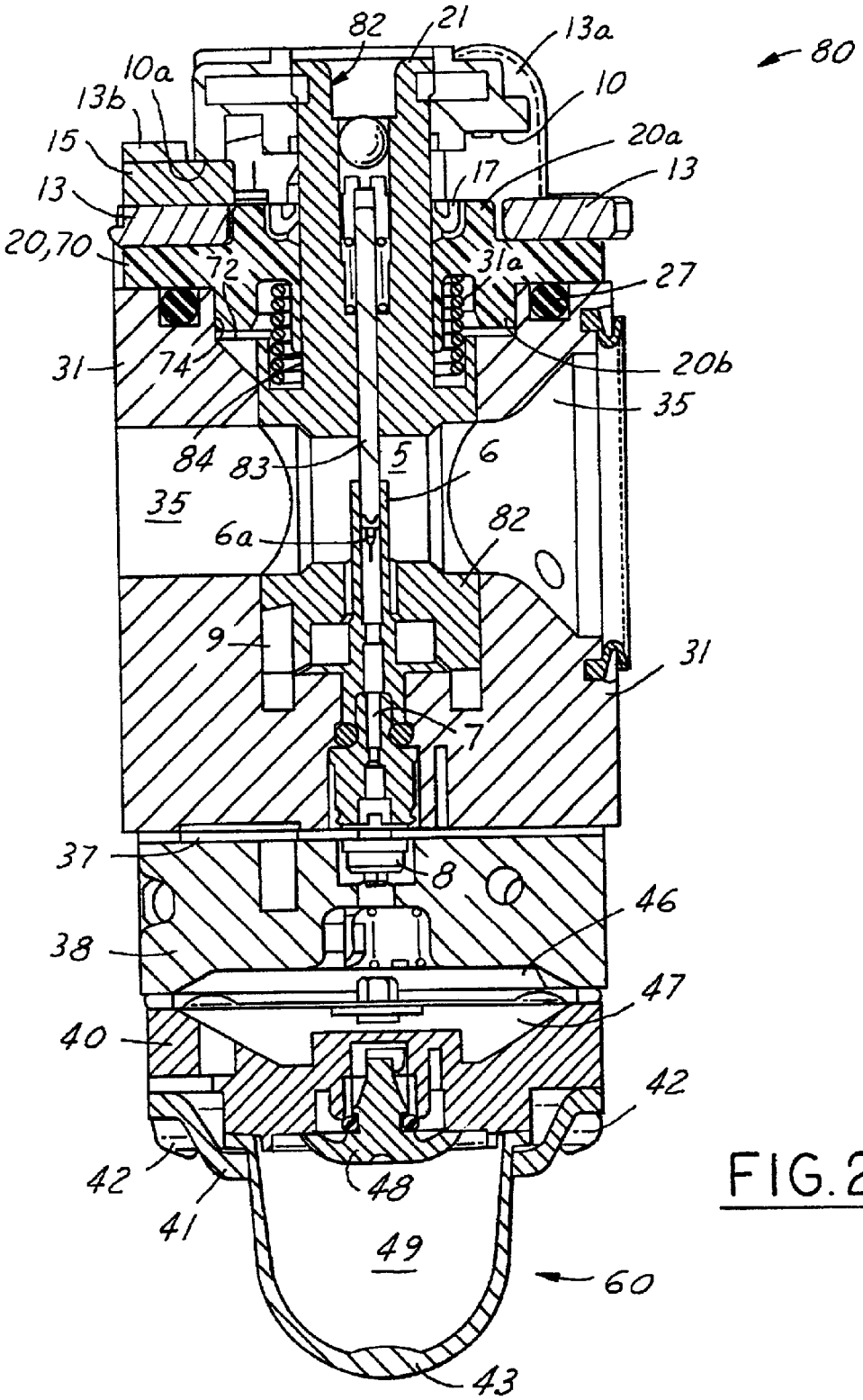
FIG. 2 is a side cross-sectional view of the rotary throttle valve carburetor.
Figure 3:
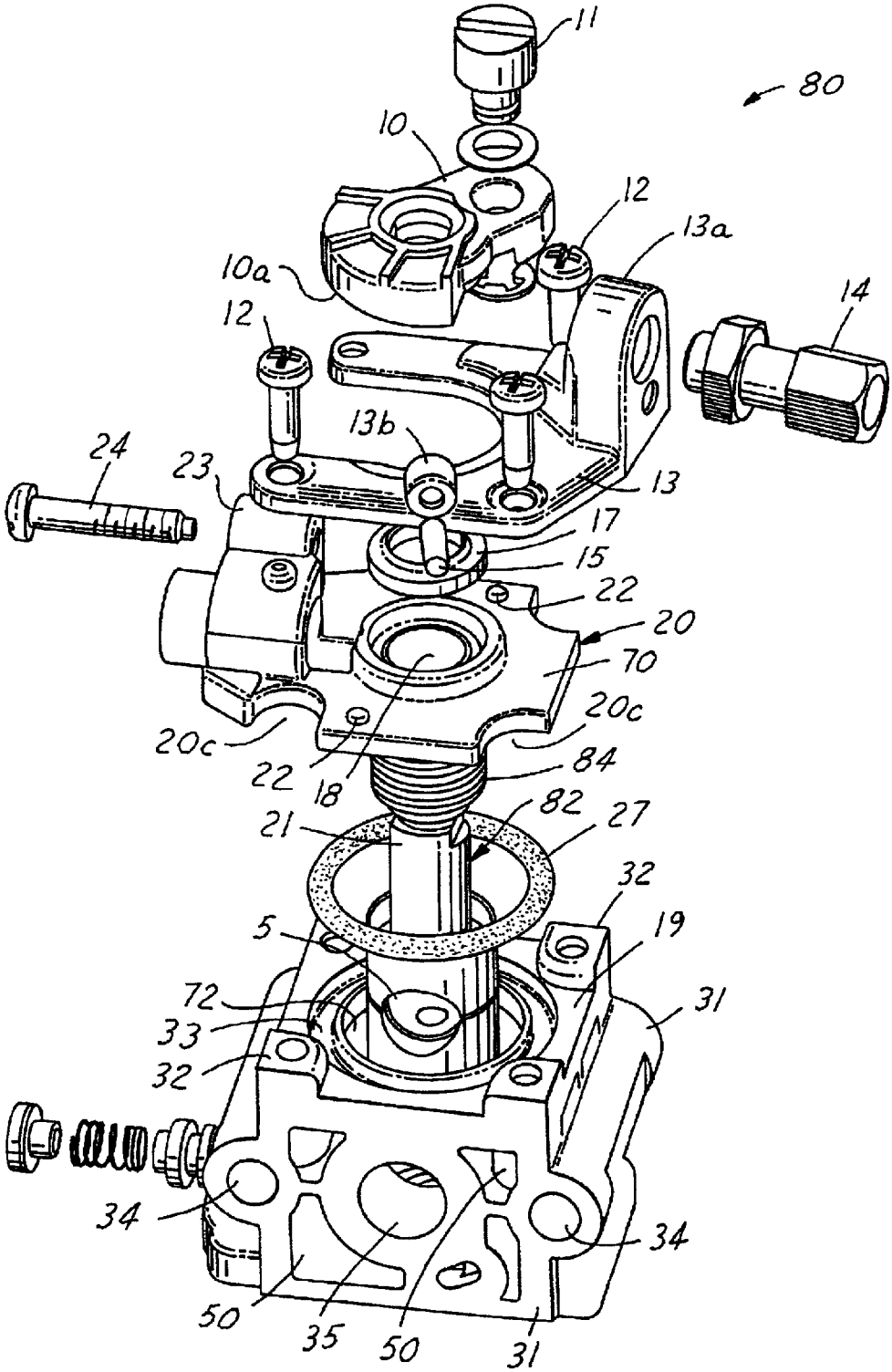
FIG. 3 is an exploded perspective view of the rotary throttle valve carburetor.

Referring in more detail to the drawings, FIGS. 1–3 illustrate a rotary valve carburetor 80 in accordance with the present invention. Carburetor 80 has a body 31 defining an air intake passage or channel 35 which communicates with an air filter on an upstream side and a crankcase of a two cycle engine on the downstream side. When the carburetor 80 is mounted on a two-cycle engine in an up-right position, the air intake channel 35 is substantially horizontal. The carburetor 80 is mounted on the two-cycle engine by bolts which extend through a pair of holes 34 in the carburetor body 31 extend parallel to and are disposed on either side of the fuel-and-air mixing passage 35. The carburetor body 31 is preferably made of a die-cast aluminum alloy having a plurality of cavities 50 for weight reduction.

As best shown in FIG. 3, the amount of air and fuel flow through the air intake channel 35 is controlled by an elongated cylindrical rotary throttle 82 which transverses the air intake channel 35 and is seated rotatably and vertically or axially movably within a substantially vertical cylindrical valve chamber 9 communicating through a top surface 19 of the carburetor body 31. A throttle bore 5 laterally extends through the rotary throttle 82 providing adjustable communication between the upstream and downstream ends of the air intake channel 35.

Rotation of the rotary throttle 82 causes both the throttle bore 5 to align or mis-align longitudinally with the air intake channel 35, and the rotary throttle 82 to rise or fall axially within the valve chamber 9. Providing the rotation means is a throttle shaft 21 which projects upward from the valve chamber 9, through a plastic lid plate 20 engaged to the top surface 19 of the carburetor body 31, and through a metallic U-shaped bracket 13 engaged to the top surface of the lid plate 20. A throttle lever 10 having a cam surface 10*a* on the lower surface thereof is engaged laterally to the distal end of the throttle shaft 21 substantially above the bracket 13. An inner wire of a remote control cable is connected to the throttle lever 10 by a swivel 11. The wire passes through an end of an outer tube or sheath of the control cable which is secured to a mount fitting 14 which is engaged threadably to an upward projection 13*a* of the bracket 13. For strength, bracket 13 is made of a diecast-molded aluminum or zinc alloy.

As the swivel 11 is pulled by the control cable, the throttle shaft 21 is rotated and the conventional sloped cam surface 10*a* of the throttle lever 10 rides over a cam follower. The cam follower is a horizontal roller or pin 15 projecting radially inward toward the throttle shaft 21 from an annular ring, boss or cylinder 13*b* engaged or fixed to the bracket 13. The slope of the cam surface 10*a* causes the rotary throttle 82 to move vertically or axially upward during rotation, thereby, increasing the amount of fuel flowing into the throttle bore 5. To minimize friction between the cam surface 10*a* and pin 15, therefore eliminating undue stresses placed upon the bracket projection 13*a*, the pin 15 is constructed and arranged to rotate within the ring or cylinder 13*b*. Furthermore, utilizing the pin 15 as oppose to a planar cam follower minimizes any opportunity of debris collecting between the sliding or contacting surfaces which could unintentionally lift the rotary throttle 82 thereby providing more fuel than what is actually required.

As best shown in FIG. 2, fuel flows into the throttle hole 5, where it mixes with air, from a fuel jet 7 and a fuel feed tube 6 supported centrally on an annular surface defining the bottom of the throttle chamber 9. The fuel feed tube 6 projects upward, transversing into the throttle hole 5. Fuel flows into the throttle hole 5 through at least one fuel jet orifice or aperture 6*a* which extends laterally through the wall of feed tube 6. Adjustably blocking or controlling fuel flow through aperture 6*a* of the nozzle 6 is a vertically or axially movable obstructing needle 83. The rotary throttle 82 centrally supports needle 83 as it projects downward, transversing into the throttle hole 5 and close fitted longitudinally into the fuel feed tube 6. As the rotary throttle 82 rotates and moves vertically within chamber 9, so does the obstructing needle 83 slide vertically or axially within the fuel feed tube 6 thereby adjusting or changing the size of aperture 6*a*. In addition, rotation of the rotary throttle 82 adjusts the degree or extent of communication degree between the fuel-and-air mixing passage 35 and the throttle hole 5 directly effecting the amount of air flow through the passage 35. Generally, the higher the vertical placement of the rotary throttle 82, the greater the communication or airflow; the larger the aperture size; and the greater the fuel flow into the throttle hole 5 of the rotary throttle 82.

A fuel pump or vertically movable diaphragm 37 disposed within the carburetor 80 draws fuel from a fuel tank and delivers the fuel to a fuel metering chamber 46. The fuel then flows from the chamber 46 through a check valve 8 into the fuel jet 7, through the fuel feed tube 6, where it flows into the throttle hole 5 from the aperture 6*a*. The diaphragm 37 is disposed between a bottom surface of the carburetor body 31 and an intermediate or upper plate 38. The oscillating movement of the diaphragm 37 is created by a pulsating pressure supplied from the crankcase of an operating two-cycle engine. Fuel flows toward the diaphragm 37 and into the fuel metering chamber 46 from a fuel pipe 45 projected outward from a lower surface of the upper plate 38 as best shown in FIG. 1. Defining the fuel metering chamber 46 is the lower side of upper plate 38 and an upper side of a diaphragm 39 disposed beneath the upper plate 38.

An atmospheric chamber 47 is defined between the lower side of diaphragm 39 and an upper side of a lower plate 40. A retaining plate 41 disposed below the lower plate 40 secures a peripheral edge of a flexible and resilient priming bulb 43 of a manual suction pump 60 to the carburetor 80. The diaphragm 37, the upper plate 38, the diaphragm 39, the lower plate 40 and a retaining plate 41 are secured to the underside of the carburetor body 31 by a plurality of bolts 42.

When the priming bulb 43 of the suction pump 60 is repetitively depressed manually and released, prior to starting of the engine, any fuel vapor and air existing in the diaphragm 37 fuel pump and the fuel metering chamber 46 is evacuated and replaced with liquid fuel from a priming chamber 49 defined by the priming bulb 43. A composite dual valve 48, constructed and arranged on the lower surface of lower plate 40 within the priming chamber 49, functions as both a suction valve and a discharge valve to replace the vapor with liquid fuel. During the priming function, unwanted vapor and fuel flow back to the fuel tank via the pipe 44 projecting from the upper plate 38.

Pertaining in greater detail to the present invention, a planar base portion 70 of the plastic lid plate 20 is sandwiched between the metallic U-shaped bracket 13 and the top surface 19 of the carburetor body 31. Bolts 12 disposed adjacent the corners of the top surface 19, secure the bracket 13 to the body 31 and the lid plate between them. A hole 18 centered above the valve chamber 9 communicates laterally through the base portion 70. The throttle shaft 21 integral to the rotary throttle 82 extends upward through the hole 18 of the plastic lid plate 20.

Figure 4:
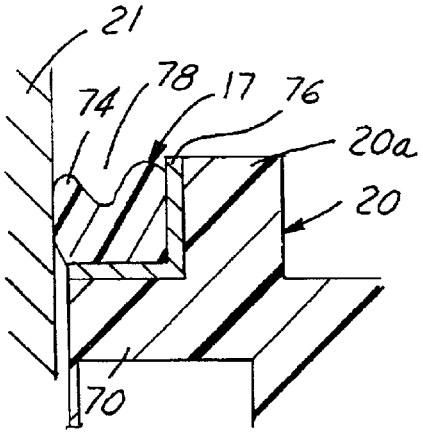
FIG. 4 is an enlarged fragmentary cross-sectional view of a resilient seal member taken from FIG. 2.

A resilient circular seal 17 prevents the intrusion of dust between the throttle shaft 21 and the plastic lid plate 20 by sealing between the cylindrical surface of the shaft 21 and an annular shoulder 20*a* of the lid plate 20. The annular shoulder 20*a* projects upward from the base portion 70, and is centered about and spaced radially outward from the hole 18. As best shown in FIG. 4, the circular seal 17 has a resilient member or rubber tongue 74 which is bonded to a metallic ring 76 having an L-shape cross section. The metallic ring 76 is engaged within an annular groove 78 formed by the shoulder 20*a* and the base portion 70 of the plastic lid plate 20 and the rubber tongue of the resilient seal member 17 is yieldably engaged in elastic with the throttle shaft 21.

Any undesirable clearance between the carburetor body 31 and the plastic lid plate 20 is sealed by a resilient seal or O-ring 27, thereby preventing intrusion of dust into the valve chamber 9 due to the deformation or aging of the plastic lid plate 20. The O-ring 27 seals between the top surface 19 of the carburetor body 31 and the base portion 70 of the lid plate 20. The O-ring 27 is disposed concentrically about the throttle shaft 21 and seats within an annular groove 33 in the top surface 19 of the carburetor body 31.

A lower annular shoulder 20*b* of the lid plate 20 projects downward from the base portion 70 past the top surface 19 into a cylindrical portion 31*a* of the valve chamber 9 defined by a cylindrical wall 74 extended downward from the top surface 19 of the carburetor body 31 to an outer perimeter of an annular shelf 72. The annular shelf 72 defining the bottom of the cylindrical portion 31*a*. Preferably, the lower annular shoulder 20*b* forms a tight fit to the cylindrical wall 74 of the carburetor body 31, thereby complimenting the O-ring 27 sealing capability. Disposed radially inward from the lower annular shoulder 20*b* and surrounding the throttle shaft 21 is a return spring 84. An upper end of the return spring 84 is engaged to the plastic lid plate 20 and a lower end of the return spring 84 is engaged to the rotary throttle 82. When the rotary throttle 82 rotates toward wide-open throttle by user operation of the control cable, the spring 84 coils up or tightens. When the control cable is released, the spring 84 uncoils causing the rotary throttle 82 to rotate back to an idle position where the throttle lever 10 contacts an idle-stop bolt 24 supported threadably by an upward projection 23 of the lid plate 20.

Positioning spacers 32 of the carburetor body 31 project upward from the top surface 19 at the corners of the body 31 and directly engage the bottom side of the metallic bracket 13. A threaded hole communicates vertically through each spacer 32 and aligns with the bolt holes of the bracket 13. The bolts 12 extend through the bracket holes and engage the threaded holes of the carburetor body 31. Because the metallic pin 15 of the metallic bracket 13 is supported to the carburetor body 31 by a series of metallic components, and not plastic, any play created by deformation or aging of the plastic lid plate 20 will not effect the repeatability or stability of fuel flow, therefore, engine performance as intended can be maintained. The lid plate 70 is aligned to the carburetor body 31 by notches 20*c* disposed at the corners of the base portion 70 and conforming about the spacers 32. In addition to the notches 20*c*, rotation of the lid plate 20 about the throttle shaft 82 is prevented by at least one positioning pin 22 projecting upward from the base portion 70 of the plastic lid plate 20 and mating with respective pin receiving holes (not shown) defined by the lower surface of the bracket 13.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention as defined by the following claims.

I claim:

1. A rotary throttle valve carburetor having a body defining a fuel-and-air mixing passage and a cylindrical valve chamber, the fuel-and-air mixing passage communicating through the body, the valve chamber extended downward from a top surface of the body communicating transversely through the mixing passage, a rotary throttle fitted rotatably and axially movable into the valve chamber, the rotary throttle having a throttle hole and a throttle shaft, the throttle hole adjustably aligning to the fuel-and-air mixing passage, the throttle shaft projected upward from the valve chamber through the top surface of the body, a throttle lever engaged to and disposed transversely of the throttle shaft, the throttle lever having a downward facing cam surface, a fuel nozzle in communication with said throttle hole and a fuel metering chamber disposed on the bottom wall of the carburetor body, and a needle supported on said rotary throttle is fitted in said fuel nozzle to regulate an opening degree of a nozzle hole, the rotary throttle valve carburetor comprising:

a lid plate engaged to the top surface of the carburetor body, the lid plate having a base portion and an annular shoulder, the base portion having a hole centered above the valve chamber, the throttle shaft projecting upward through the hole of the base portion, the annular shoulder projecting upward from the base portion and disposed concentrically to and spaced radially outward from the hole of the base portion;

a circular seal disposed radially between the annular shoulder of the lid plate and the throttle shaft;

a bracket, the base portion of the lid plate juxtaposed between the carburetor body and the bracket, the bracket disposed radially outward from the annular shoulder of the lid plate, the bracket having a cam follower engaged operatively to the downward facing cam surface of the throttle lever; and a plurality of spacers juxtaposed between the carburetor body and the bracket and bearing on the bracket to axially locate the bracket relative to the carburetor body.

2. The carburetor as set forth in claim 1 further comprising a resilient seal juxtaposed between the top surface of the carburetor body and the base portion of the lid plate, the resilient seal encircling the throttle hole.

3. The carburetor as set forth in claim 2 further comprising:

the carburetor body defining a recessed annular shelf and a cylindrical wall extending downward from the top surface to an outer perimeter of the annular shelf, the annular shelf disposed concentrically about the throttle hole; and the lid plate having a lower annular shoulder projecting downward from the base portion past the top surface and toward the annular shelf of the carburetor body, the lower annular shoulder close fitted to the cylindrical wall of the carburetor body.

4. The carburetor as set forth in claim 3 wherein the upward facing cam follower of the bracket is a pin protruding radially inward toward the throttle shaft from a cylinder engaged rigidly to the bracket.

5. The carburetor as set forth in claim 4 wherein the pin is constructed and arranged to rotate within the cylinder, the pin thereby rolling across the cam surface of the throttle lever as the rotary throttle rotates.

6. The carburetor as set forth in claim 4 wherein the top surface of the carburetor body defines a circular groove disposed concentrically about the throttle hole, and wherein the resilient seal is an O-ring seated within the circular groove.

7. The carburetor as set forth in claim 6 wherein the bracket, the cylinder, the pin, the plurality of spacers and the carburetor body are metallic and the lid plate is plastic.

8. The carburetor as set forth in claim 7 wherein the circular seal has a resilient member engaging the throttle shaft and a reinforcement metallic sleeve engaging the lid plate.

9. The carburetor as set forth in claim 8 wherein the plurality of spacers are unitary to the carburetor body.

10. The carburetor as set forth in claim 9 further comprising a plurality of fasteners, each one of the plurality of fasteners engaging a respective one of the spacers to the bracket.

11. The carburetor as set forth in claim 10 wherein the plurality of fasteners are bolts engaged threadably to the carburetor body through the bracket and each respective one of the plurality of spacers.

12. The carburetor as set forth in claim 11 wherein the bracket is diecast-molded of a metal selected from the group consisting of an aluminum alloy and a zinc alloy.

13. The carburetor as set forth in claim 12 wherein the base portion of the lid plate has a plurality of notches, each one of the plurality of notches indexing about each respective one of the plurality of spacers of the carburetor body.

* * * * *